United States Patent [19]

Ingerle et al.

[11] 4,071,087

[45] Jan. 31, 1978

[54] WELL CONSTRUCTION

[75] Inventors: Kurt Ingerle, Gotzens; Karl Meister, Simbach, both of Germany

[73] Assignee: Ferdinand Aufschlager KG., Munich, Germany

[21] Appl. No.: 711,901

[22] Filed: Aug. 5, 1976

Related U.S. Application Data

[63] Continuation of Ser. No. 526,937, Nov. 25, 1974, abandoned.

[30] Foreign Application Priority Data

Nov. 28, 1973 Germany ..... 2359231

[51] Int. Cl.[2] ..... E21B 43/04

[52] U.S. Cl. ..... 166/278; 166/245

[58] Field of Search ..... 61/11; 166/50, 51, 245, 166/276, 278

[56] References Cited

U.S. PATENT DOCUMENTS

| | | | |
|---|---|---|---|
| 1,748,589 | 2/1930 | Thorpe | 166/278 |
| 2,025,317 | 12/1935 | Thorpe | 166/278 |
| 2,076,489 | 4/1937 | Williams | 166/278 X |
| 2,076,490 | 4/1937 | Williams | 166/278 X |
| 2,434,239 | 1/1948 | Zublin | 166/278 |
| 3,007,522 | 11/1961 | Clausse | 166/278 |

FOREIGN PATENT DOCUMENTS

| | | | |
|---|---|---|---|
| 1,290,022 | 2/1962 | France | 166/278 |

*Primary Examiner*—Ernest R. Purser
*Attorney, Agent, or Firm*—William A. Drucker

[57] ABSTRACT

In a method of constructing a filter well by forming a cavity, such as a bore, in the ground down to the level of the liquid-bearing zone of the strata and filling said cavity with a filtering medium such as filter gravel, the cavities are disposed so as to intersect along their length such that each cavity is in communication with at least one other cavity. In a preferred method, the cavity is formed and provided with a liner, and the liner is withdrawn as the filter medium is installed. Preferred arrangements of the cavities include single lines, intersecting lines, closed figures and especially circles occupied entirely by cavities, and lines radial to a central cavity.

6 Claims, 4 Drawing Figures

WELL CONSTRUCTION

This is a continuation of Ser. No. 526,937, filed Nov. 25, 1974 and now abandoned.

This invention relates to a method of constructing a filter well, when using a method of sinking, and particularly the dry drilling method, in which a filter material, and especially filter gravel, is poured in at least in the region of the producing strata.

So-called artesian wells serve for economic exploitation of larger water quantities. With this kind of well the usual depths of bore which can be attained, where the diameter of the bore is limited by reason of the known methods of drilling to about 1150 mm., is about 50 meters. The borehole is then sunk, for instance, by the dry drilling method, i.e. piping which lines the drilled holes is sunk concurrently with the progress of drilling. A filter pipe is afterwards inserted in the centre of the bore and the annular space between the filter pipe and the walls of the borehole is filled with gravel, at the same time as the lining pipe is withdrawn. Water-bearing strata of every potential, lying at relatively great depths, can be tapped by vertical wells of this type. Naturally, the capacity of the well is limited by the diameter of the bore, which at the same time determines the impounding diameter.

Because of the known advantages, the vertical filter well has extensively supplanted the earlier very wide shaft well. The latter is characterised by its relatively broad construction, with diameters up to about 6 meters. On account of the small shaft depth, the capacity of the shaft well in the ground water region is small, so that it mainly forms the so-called imperfect well, in which water penetration is mostly at the bottom. Thus, in relation to the diameter, there is a small filter area. A merit of the shaft well is that at the same time it can serve for water storage.

The yield of the vertical filter well is limited by the maximum diameter of known methods of drilling. The yield of the shaft well is small on account of the small filter surface at the bottom of the well. Consequently, the large available capacity resulting from its diameter remains unused.

The known horizontal filter well was developed in the search for a well with greater yield. This type of well is very expensive in construction because a vertical bore and one or more horizontal bores leading out from the bottom have to be made. The expense is increased still more because, in order to determine the direction of drilling for the horizontal bores, fairly comprehensive initial trials by test bores are unavoidable. Also, in this type of well, increase in the yield is limited because a high rate of bottom permeability causes a concentration of infeed at the vertical well shaft, so that the yield of the well again essentially depends upon the filtering cross-section.

The formation of slots through boreholes which intersect in lengthwise direction, and filling the slots with sealing material, is known for making formations watertight, (French patent specification No. 1,308,548).

The basis of the present invention is to create a well of greater yield which combines the advantages of the vertical filter well in regard to its depth, with those of the shaft well in regard to its large capacity, but which is nevertheless at the same time simpler and considerably less expensive to construct than the known horizontal filter well.

According to the present invention, this is achieved in that a plurality of bored holes or cavities, which mutually intersect over their whole lengths, are sunk at the same time to the lie of the strata to be filtered, and in that a continuous filter body which fills the capacity of the well is formed. Within the scope of this invention it is sufficient for each borehole to intersect with at least one other.

The result is the creation of well capacity which is optionally greater in accordance with the number of boreholes sunk, and is limited only by the technique of well drilling. Drilling depths up to about 50 meters can be reached by using the dry method. Such a well, by reason of its considerably larger circumferential wall face bordering on the water-bearing strata, in comparison with known constructions, offers the possibility of adaption to every increasing need. Calculations have shown, for example, that tripling the diameter of the storage space, depending upon the capacity of the ground water channels, and the permeabilityof the bottom, gives an increase in the capacity of the well for supplying water of up to two or three times. The construction costs are then considerably less than, for example, in the case of the horizontal filter well, since use of the dry drilling method for forming vertical boreholes, and even intersecting boreholes, according to the present state of technology, presents no difficulties. Just as it has long been technically possible to construct thick concrete walls, mutually overlapping concrete piles are constructed on site; first of all a row of spaced piles are produced, and then adjoining piles are produced two at a time to form boreholes intersecting one another over their whole length; after filling with concrete they form a closed wall. An advantage of the present invention is the profitable employment of this known technique of making site concrete walls for foundations of buildings, quay walls, underground railway shafts, etc., in the sector of constructing wells, and to exploit it as a combination of a vertical bored filter well and a shaft well.

Further features of the invention are that, to commence, an initial series of boreholes is sunk with a mutually smallest spacing of their walls, which is smaller than the bore diameter of a second series of boreholes sunk subsequently, and which bridge over each spacing.

The boreholes of the first series, where appropriate during withdrawal of the used piping, are then filled with filter gravel, and the second series is then sunk and filled with filter gravel.

The storage space of such wells can vary in cross-section within wide limits. It is possible for all boreholes, as seen from above, to be sunk with their centres along a straight or curved line.

Another possibility is for the boreholes, as seen from above, to be sunk with their centres along two or several mutually intersecting straight or curved lines.

A further variation is characterised by a proportion of the boreholes, as seen from above, being sunk with their centres along a closed line, for example, a circle or an ellipse, and a second portion being sunk inside the area enclosed by said line, at least the enclosed surface becoming fully covered by the boreholes.

When using the above-mentioned variations, storage spaces in the form of slots or cylinders occur where the boreholes are sunk in a circle around a centre bore, or star-wise, where the boreholes spread out radially from a centre bore.

The boreholes can be filled with filter gravel of various coarseness, or with so-called single-grain concrete. Thus it lies within the discretion of the expert to suit the coarseness of the filter material, at least in the periphery of the storage space, to that of the surrounding terrain, and to graduate it from the filter pipe as the case may be, when the material in the region immediately surrounding the filter pipe should offer about the same permeability as the slots in the filter pipe. It is an especial advantage of the method, according to the invention, that it is possible to graduate the filter gravel, as regards coarseness, for each borehole.

It can be of advantage to provided several filter beds in the region of the gravel bed forming the storage space. In this manner, the greatest possible widths of filter slot can be used, which further increases the yield of the well.

Furthermore, it is an advantage of the method according to the invention that a vertical filter well can be subsequently enlarged, since further boreholes can be sunk, which are connected with one another and with the existing well storage space.

With regard to the possibility of sealing against contamination by surface water, as well as for removing sand, the technique and experience in connection with vertical wells can be used without limit.

Further features of the invention will be apparent from the following description of several examples of construction, with reference to the accompanying drawings.

Figure 1:
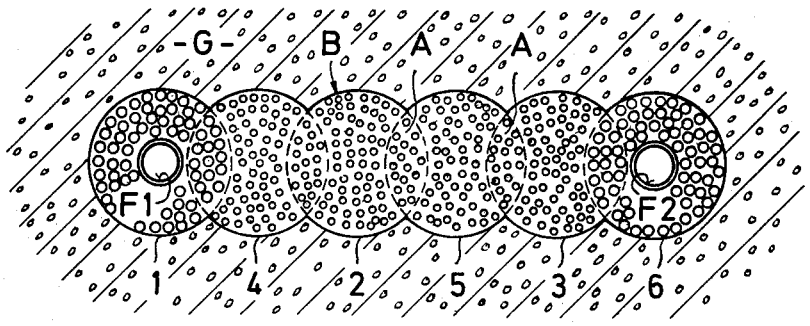
FIG. 1 is a schematic view of a well of slot construction.
Figure 2:
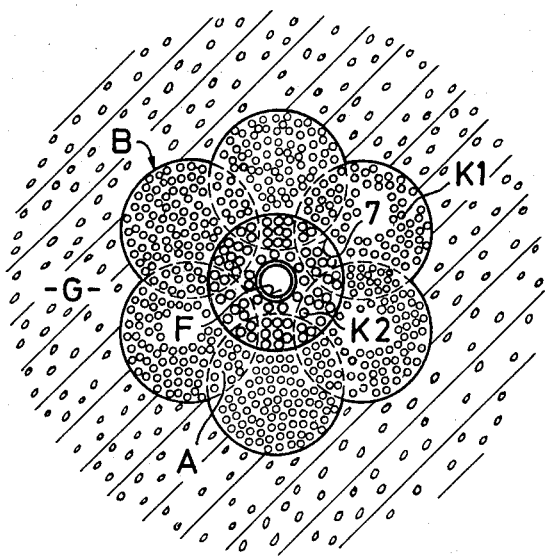
FIG. 2 is a schematic view of a well with a cylindrical storage space.

According to FIG. 1, the storage space of the well is formed by six boreholes arranged along a straight line. The boreholes 2 and 3 are sunk first and filled with filter gravel, followed by the boreholes 4 and 5, and finally boreholes 1 and 6, which are piped as storage space. Naturally, other sequences are possible, for example, boreholes 4 and 5 can be sunk first, then boreholes 2 and 3. The storage spaces can also be in other bores. The boreholes actually adjacent to one another intersect over a cross-sectional area A. The well has two filter pipes $F_1$ and $F_2$. The ground water flowing into the gravel bed B from the surrounding highlands G creates a definite ground water column inside the filter pipes $F_1$ and $F_2$, from which the collected water is pumped. Whereas, with the arrangement of slots as shown in FIG. 1 at the most two others are cut from one borehole, with the cylindrical arrangement in FIG. 2 there is a total of six boreholes which are intersected by the central bore 7. The gravel bed B of the storage space borders immediately, without graduation, on that of the surrounding highlands G. Filter pipe F is arranged in the central borehole. The outer boreholes, sunk is a suitable sequence, are filled with a filter gravel of a coarseness K1 corresponding to the sieve analysis. During sinking of the central bore 7, the gravel is again removed from the intersecting areas. After filter pipe F is placed in position the central bore is filled with a filter gravel of a coarser grade K2, and obviously only in the region of the annular space between the filter pipe F and the walls of the centre borehole.

Figure 3:
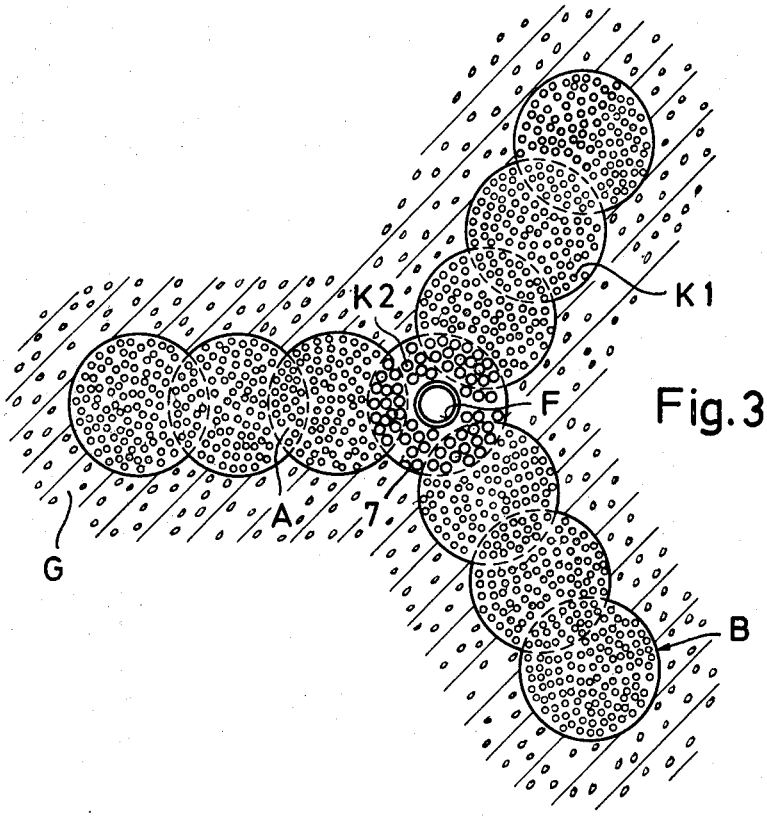
FIG. 3 is a schematic view of a well with star-shaped storage space.

A star arrangement of the well according to the invention is likewise shown diagrammatically in FIG. 3. The three armforming boreholes are sunk first. Finally, the centre bore with the filter pipe F is sunk.

Figure 4:
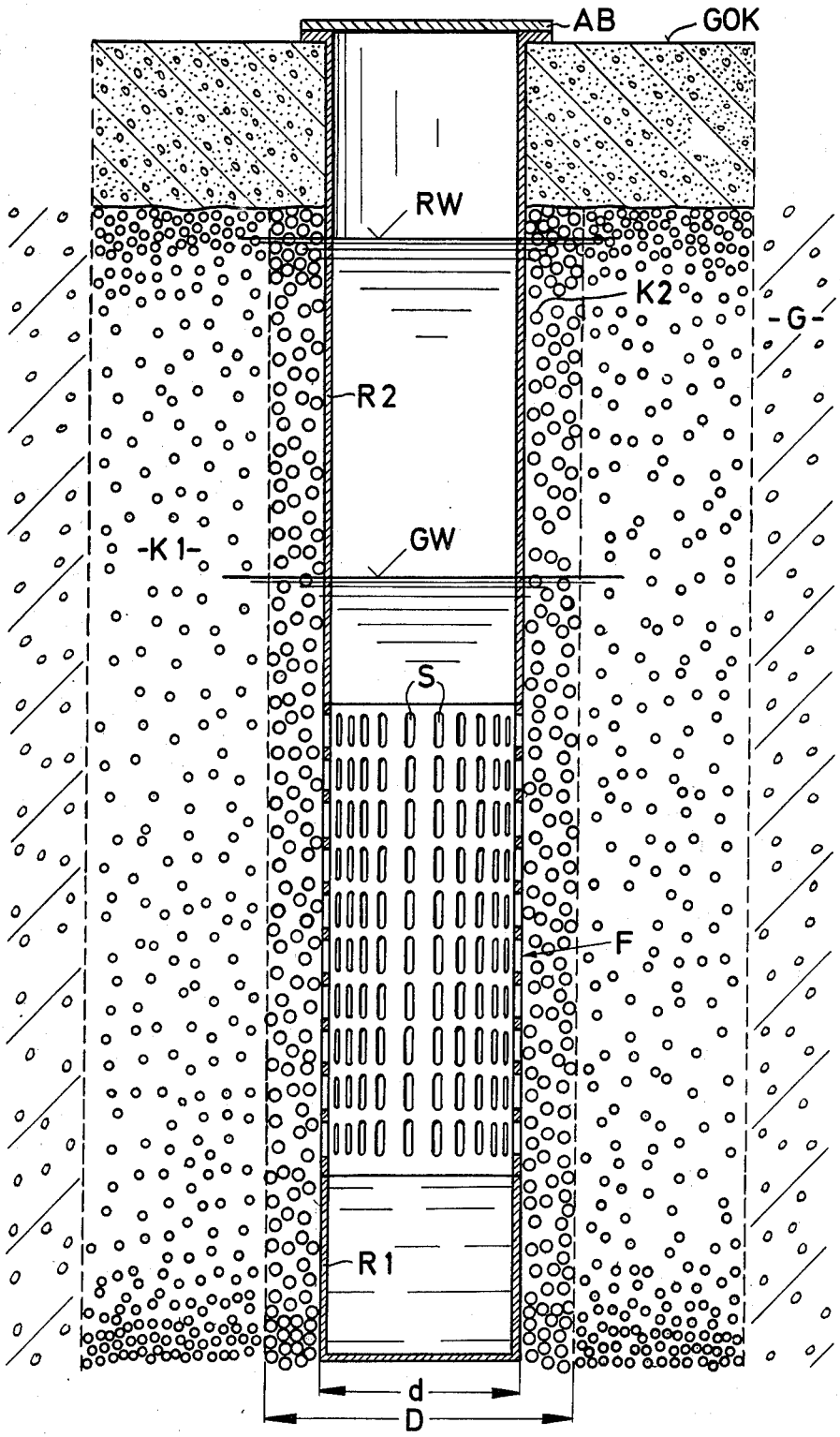
FIG. 4 is a vertical section through the well shown in FIG. 2.

The vertical section through a well of cylindrical cross-section, as shown in FIG. 4, is shown shortened in its vertical extension. The total depth of the well amounts, for example, to 25 metres, the diameter of the filter pipe *d* is 900 mm., the diameter D of the gravel bed of coarser grade K2, in conformity with the borehole, is 1200 mm. The filter pipe with slots S for entry of the ground water is arranged at depths between 13 and 22 meters. The filter pipe is of stainless steel or plastics, the width of the slots being about 5 mm. A sump pipe R1 is arranged underneath the filter pipe. A complete unslotted pipe R2 connects to the land surface at GOK. Cover AB closes the well above. For simplification of the drawing, the pumping plant is omitted. The natural water table RW is at 4 meters, and the lowered water table GW or working level is at about 10 meters. All dimensions are understood to be from the surface of the land downwards.

In practice, all boreholes are appropriately made with the same drilling tool. However, it is not excluded that the boreholes may be drilled to different diameters.

I claim:

1. In a method of constructing a filter water well in a region of water-bearing strata which comprises the steps of:

i. sinking in said water-bearing strata a plurality of first cavities and providing a respective lining piping in each first cavity, said first cavities being spaced laterally at a selected spacing;

ii. withdrawing the lining piping from each first cavity and simultaneously filling said cavity with a first gravel filling of a size selected for use as a filter;

iii. thereafter sinking in said water-bearing strata at least one cavity, of width greater than said selected spacing, so as to intersect at least one of said first cavities along the whole of the depth of said first cavities and providing a lining piping in said second cavity;

iv. providing in at least one second cavity a filter pipe which includes in its wall a plurality of openings: the improvement which includes withdrawing the lining piping from said second cavity while simultaneously filling the space of said second cavity externally of said filter pipe with a second gravel filling of a larger size than said first gravel filling.

2. The method claimed in claim 1 wherein the total area of said openings, per unit area of the surface of said filter pipe is selected in accordance with the total area of the interstices in said second gravel filling per same unit area.

3. The method claimed in claim 1 wherein the total area of said openings, per unit area of the surface of said filter pipe, is selected to offer about the same water permeability as said second gravel filling.

4. The method claimed in claim 1 wherein, when viewed in plan, said first and second cavities have their centers arranged approximately on a straight line.

5. The method claimed in claim 1 wherein, when viewed in plan, said first cavities have their centers arranged on a line forming a closed figure, and wherein said at least one second cavity lies within said closed figure, said closed figure being wholly occupied by said at least one second cavity and part of each of said first cavities.

6. The method claimed in claim 1 wherein, when viewed in plan, said first cavities are arranged in at least two groups each having their centers arranged approximately on a respective straight line, and wherein said straight lines extend radially from the center of said second cavity.

* * * * *